US012287179B2

(12) United States Patent
Wang et al.

(10) Patent No.: US 12,287,179 B2
(45) Date of Patent: Apr. 29, 2025

(54) SPIKE RESISTANT PACKAGE AND ARTICLE

(71) Applicant: Milliken & Company, Spartanburg, SC (US)

(72) Inventors: Yunzhang Wang, Duncan, SC (US); Heather J. Hayes, Chesnee, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 18/540,137

(22) Filed: Dec. 14, 2023

(65) Prior Publication Data

US 2024/0255260 A1 Aug. 1, 2024

Related U.S. Application Data

(60) Provisional application No. 63/481,670, filed on Jan. 26, 2023.

(51) Int. Cl.
*F41H 5/04* (2006.01)
*D03D 1/00* (2006.01)
(Continued)

(52) U.S. Cl.
CPC ..... *F41H 5/0485* (2013.01); *D03D 1/0041* (2013.01); *D03D 13/008* (2013.01);
(Continued)

(58) Field of Classification Search
CPC .. F41H 5/0485; D03D 1/0041; D03D 13/008; D03D 15/283; D03D 15/50; D03D 11/00;
(Continued)

(56) References Cited

U.S. PATENT DOCUMENTS 3,601,923 A 8/1971 Rosenberg
4,186,648 A 2/1980 Clausen
(Continued)

FOREIGN PATENT DOCUMENTS

CA 3071535 A1 2/2019
WO 2006121411 11/2006
(Continued)

OTHER PUBLICATIONS

International Search Report and Written Opinion issued in App. No. PCT/US2024/11621, mailing date Apr. 24, 2024, 10 pages.

*Primary Examiner* — Robert H Muromoto, Jr.
(74) *Attorney, Agent, or Firm* — Cheryl J. Brickey

(57) ABSTRACT

A spike resistant package containing a pouch, a first grouping of spike resistant textile layers, and a slip layer. The first grouping of spike resistant textile layers contains a plurality of spike resistant textile layers, where each spike resistant textile layer contains a plurality of interwoven yarns or fibers having a tenacity of about 14 or more grams per denier. The slip layer is a woven or knit fabric containing a main portion and a first pile portion on the upper surface of the main portion. The slip layer contains a plurality of yarns knitted or woven together and a plurality of holes between the yarns. The holes of the slip layer have an average max hole size of less than about 2 mm. The yarns and fibers in the pile portion are in loops or strands extending outward from the main portion of the slip layer.

22 Claims, 3 Drawing Sheets

(51) Int. Cl.

| | |
|---|---|
| ***D03D 13/00*** | (2006.01) |
| ***D03D 15/283*** | (2021.01) |
| ***D03D 15/50*** | (2021.01) |
| ***D04B 1/16*** | (2006.01) |
| ***D04B 1/24*** | (2006.01) |
| ***D04B 21/20*** | (2006.01) |
| ***D06M 11/45*** | (2006.01) |
| *D06M 101/36* | (2006.01) |

(52) U.S. Cl.
CPC ..... *D03D 15/283* (2021.01); *D03D 15/50* (2021.01); *D04B 1/16* (2013.01); *D04B 1/24* (2013.01); *D04B 21/207* (2013.01); *D06M 11/45* (2013.01); *D06M 2101/36* (2013.01); *D10B 2201/02* (2013.01); *D10B 2331/02* (2013.01); *D10B 2331/04* (2013.01); *D10B 2401/06* (2013.01); *D10B 2501/00* (2013.01)

(58) Field of Classification Search
CPC ..... D03D 15/225; D03D 15/593; D04B 1/16; D04B 1/24; D04B 21/207; D06M 11/45; D06M 2101/36; D10B 2201/02; D10B 2331/02; D10B 2331/04; D10B 2401/06; D10B 2501/00; D10B 2101/12; D10B 2201/20; D10B 2321/021; D10B 2321/0211; D10B 2331/021; D10B 2401/062
See application file for complete search history.

(56) References Cited

U.S. PATENT DOCUMENTS 4,292,882 A * 10/1981 Clausen ..... B32B 5/26 109/81
4,425,080 A 1/1984 Stanton
4,623,574 A 11/1986 Harpell
4,690,825 A 9/1987 Won
4,879,165 A 11/1989 Smith
4,916,000 A 4/1990 Li
4,961,685 A * 10/1990 Neubert ..... F01D 21/045 415/197
4,969,386 A 11/1990 Sandstrom
5,011,183 A 4/1991 Thornton
5,035,111 A 7/1991 Hogenboom
5,036,603 A * 8/1991 Dischler ..... A43B 17/00 36/43
5,045,371 A 9/1991 Calkins
5,110,661 A 5/1992 Groves
5,145,675 A 9/1992 Won
5,225,241 A 7/1993 Dischler
5,275,873 A 1/1994 Chitrangad
5,322,721 A 6/1994 McGinnis, Jr.
5,402,703 A * 4/1995 Drotleff ..... F41H 5/04 89/36.02
5,437,905 A 8/1995 Park
5,443,882 A 8/1995 Park
5,443,883 A 8/1995 Park
5,466,503 A 11/1995 Dischler
5,547,536 A 8/1996 Park
5,569,509 A 10/1996 Dischler
5,580,629 A 12/1996 Dischler
5,776,839 A 7/1998 Dischler
5,880,042 A 3/1999 Schuster
6,133,169 A * 10/2000 Chiou ..... F41H 5/0464 442/232
6,248,676 B1 6/2001 Dischler
6,475,936 B1 11/2002 Chiou
6,543,055 B2 4/2003 Howland
6,656,570 B1 12/2003 Fels
6,737,368 B2 5/2004 Chiou
6,846,548 B2 1/2005 Harpell
6,893,989 B2 5/2005 Breukers
7,642,206 B1 1/2010 Bhatnagar
7,825,048 B2 11/2010 Wang
8,236,711 B1 8/2012 Wang
10,513,806 B2 * 12/2019 Wang ..... D03D 13/008
10,702,009 B2 * 7/2020 Wang ..... A43B 17/02
2002/0106957 A1 8/2002 Ritter
2004/0016036 A1 1/2004 Bachner
2004/0048109 A1 3/2004 Granqvist
2004/0048538 A1 3/2004 Granqvist
2005/0266748 A1 12/2005 Wagner
2009/0311930 A1 * 12/2009 Wang ..... B32B 5/026 442/134
2012/0183720 A1 * 7/2012 Wang ..... F41H 5/0485 428/68
2019/0048496 A1 * 2/2019 Wang ..... F41H 1/04

FOREIGN PATENT DOCUMENTS

WO 2007047508 4/2007
WO 2010142028 12/2010
WO 2011024011 3/2011
WO 2013072667 5/2013

* cited by examiner

SPIKE RESISTANT PACKAGE AND ARTICLE

RELATED APPLICATIONS

This application claims priority to U.S. Provisional Patent Application 63/481,670, filed on Jan. 26, 2023, which is herein incorporated by reference in its entirety.

FIELD OF THE INVENTION

The present application is directed to spike resistant packages and articles such as spike resistant vests.

BACKGROUND

Police, correctional officers, security personnel, and even private individuals have a growing need for protection from spike threats that give good protection while being light and less expensive. It is a primary object to provide a flexible light weight structure that resists penetration by spike-like threats.

BRIEF SUMMARY OF THE INVENTION

A spike resistant package containing a pouch, a first grouping of spike resistant textile layers, and at least one slip layer. The pouch has an inner surface, an outer surface, and an enclosed space.

The first grouping of spike resistant textile layers contains a plurality of spike resistant textile layers, where each spike resistant textile layer contains a plurality of interwoven yarns or fibers having a tenacity of about 14 or more grams per denier. The first grouping of spike resistant textile layers is located within the enclosed space of the pouch.

The slip layer is a woven or knit fabric having a first and second side and containing a main portion having an upper and lower side and a first pile portion on the upper surface of the main portion. The slip layer may also contain a second pile portion on the lower surface of the main portion. The slip layer contains a plurality of yarns knitted or woven together and a plurality of holes between the yarns. The plurality of yarns contains a plurality of fibers. The slip layer is located within the enclosed space of the pouch between the first grouping of spike resistant textiles layers and the inner surface of the pouch.

The holes of the slip layer have an average max hole size of less than about 2 mm. A portion of the yarns and fibers of the slip layer reside in the main portion of the slip layer and a portion of the yarns and fibers of the slip layer are in the pile portion of the slip layer. The yarns and fibers in the pile portion are in loops or strands extending outward from the main portion of the slip layer.

DETAILED DESCRIPTION OF THE INVENTION

As utilized herein, the term "spike resistant" is generally used to refer to a material that provides protection against penetration of the material by sharp-pointed weapons or objects, such as an ice pick or a shank made by a prisoner. Thus, a "spike resistant" material can either prevent penetration of the material by such an object or can lessen the degree of penetration of such an object as compared to similar, non-spike resistant materials. Preferably, a "spike resistant" material achieves a pass rating when tested against Level 1, Spike class threats in accordance with National Institute of Justice (NIJ) Standard 0115.00 (2000), entitled "Stab Resistance of Personal Body Armor." The term "spike resistant" can also refer to materials (e.g., a composite according to the invention) achieving a pass rating when tested against higher level threats (e.g., Level 2 or Level 3).

In certain possibly preferred embodiments, the invention can also be directed to a spike resistant package that also has knife and/or ballistic resistant properties.

When a spike strikes the first grouping of spike resistant textile layers without a pouch, the spike resistant textile layers can move more freely and interact fully with the spike, dissipating energy more effectively. When the spike resistant textile layers are enclosed inside a pouch, the movement of the spike resistant textile layers tends to be more restricted. As a result, the spike resistant textile layers may be less able to interact fully with the spike to effectively dissipate energy. When a slip layer being a specially designed knit or woven layer with a pile is used, the interaction between the spike resistant textile layers and the inner surface of the pouch is reduced, allowing the spike resistant textile layers to interact with the spike and dissipate energy more effectively.

Figure 1:
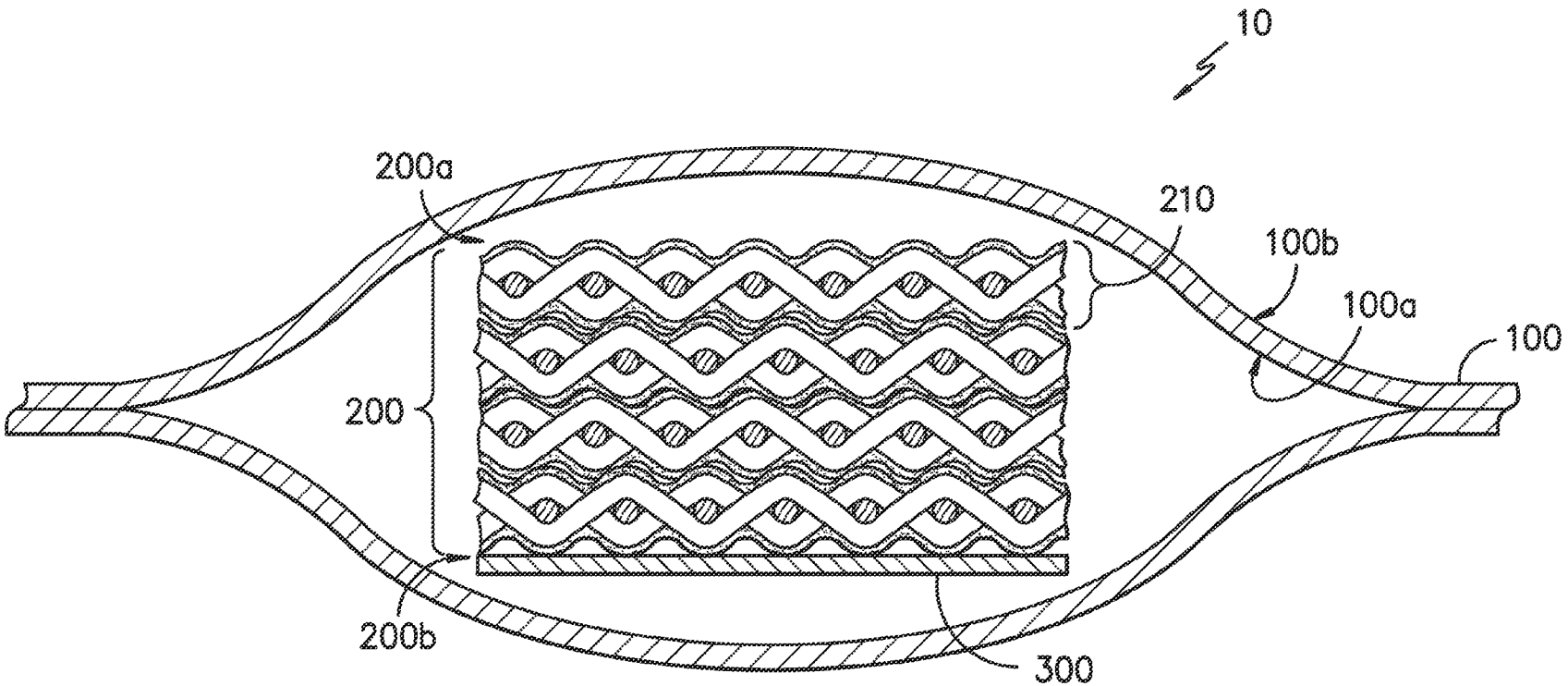
FIG. 1 is a sectional view of one embodiment of a spike resistant package.

Referring now to FIG. 1, in one embodiment the spike resistant package 10 contains a pouch 100 which contains the first grouping 200 of spike resistant layers 210 and the slip layer 300. The pouch 100 contains an inner surface 100*a* and an outer surface 100*b*. The pouch 100 at least partially surrounds the first grouping 200 of spike resistant layers 210 and the slip layer 300, more preferably, fully surrounds and encapsulates the first grouping 200 of spike resistant layers 210 and the slip layer 300.

In one embodiment, the pouch 100 comprises a pouch textile. The pouch textile can be any suitable textile including a woven, knit, or nonwoven textile. The pouch textile can be made from fibers such as polyester, nylon, or other common fiber materials. It can be dyed and finished to impart color, moisture resistance, and/or flame resistance. The pouch may have labels or other insignia on the outside or inside surface. The textile can be back-coated to impart enhanced performance in water, air, or flame resistance with polyurethane, acrylic, or other back-coating materials. In another embodiment, the pouch 100 may be a polymeric film, with or without fiber reinforcements.

The first grouping of textile layers 200 has a first side 200*a* and a second side 200*b*. The spike resistant textile layers 210 are preferably woven textiles. Each spike resistant textile layer 210 contains a plurality of interlocking yarns or fibers 212 having a tenacity of about 5 or more grams per denier, more preferably about 8 or more, more preferably about 10 or more, more preferably about 14 or more, more preferably 15 or more. In a preferred embodiment, the plurality of yarns or fibers 212 have a tenacity of about 10 or more grams per denier and have a size of less than ten denier per filament, more preferably less than 5 denier per filament. In one embodiment, the fibers have an average diameter of less than about 20 micrometers, more preferably less than about 10 micrometers. The spike resistant textile layers 210 can have any suitable weight. In certain possibly preferred embodiments, the spike resistant textile layers 212 can have a weight of about 2 to about 10 ounces per square yard. "About" as used throughout this specification and claims is defined to mean within 5% of number. For example, about 10 g would encompass 9.5 to 10.5 g.

For the fibers or yarns interwoven in the spike resistant textile layers 210 a non-inclusive listing of suitable fibers and yarns include, fibers made from highly oriented polymers, such as gel-spun ultrahigh molecular weight polyethylene fibers, melt-spun polyethylene fibers, melt-spun nylon fibers, melt-spun polyester fibers, and sintered polyethylene fibers. Suitable fibers also include those made from rigid-rod polymers, such as lyotropic rigid-rod polymers, heterocyclic rigid-rod polymers, and thermotropic liquid-crystalline polymers. Suitable fibers made from lyotropic rigid-rod polymers include aramid fibers, such as poly(p-phenylene-terephthalamide) fibers and fibers made from a 1:1 copolyterephthalamide of 3,4'-diaminodiphenylether and p-phenylenediamine. Suitable fibers made from heterocyclic rigid-rod polymers, such as p-phenylene heterocyclics, include poly(p-phenylene-2,6-benzobisoxazole) fibers (PBO fibers), poly(p-phenylene-2,6-benzobisthiazole) fibers (PBZT fibers), and poly[2,6-diimidazo[4,5-b:4',5'-e] pyridinylene-1,4-(2,5-dihydroxy)phenylene] fibers (PIPD fibers). Suitable fibers made from thermotropic liquid-crystalline polymers include poly(6-hydroxy-2-napthoic acid-co-4-hydroxybenzoic acid) fibers. Suitable fibers also include carbon fibers, such as those made from the high temperature pyrolysis of rayon, polyacrylonitrile, and mesomorphic hydrocarbon tar. In certain possibly preferred embodiments, the yarns or fibers 113 and 212 comprise fibers selected from the group consisting of gel-spun ultrahigh molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof. In one particularly preferred embodiment, the spike resistant textile layer 210 comprises aramid fibers 212. In another particularly preferred embodiment, the strike face layer 110 comprises aramid fibers 113 and coating 111 (the coating 111 can be any suitable coating listed for coatings 215). The strike face layer 110 has a strike face surface 11 and this surface in some embodiments would be the first surface the composite encounter the spike or other projectile.

In one embodiment, at least a portion of the spike resistant textile layers 210 comprise about 10 wt. % or less, based on the total weight of the textile layer, of a coating comprising a plurality of particles having a diameter of about 20 μm or less on at least one side of the textile layer 210. More preferably, the plurality of particles having a diameter of about 4 μm or less, more preferably a diameter of about 2 μm or less. In one embodiment, at least 50% by number of the textile layers 210 contain the coating. In another embodiment, at least 75% by number, more preferably at least about 90% by number of the textile layers 210 contain the coating. In another embodiment, each (essentially 100% by number) of the textile layers 210 contain the coating. The first group 200 preferably contains at least 2 spike resistant textile layers 210, more preferably at least about 3 layers, more preferably at least about 4 layers. While the spike resistant textile layer 210 is described as being spike resistant, the textile layer 210 may also have knife and/or ballistic resistant properties.

It has been found that the particle treated spike resistant textile layers 210 had significantly higher spike penetration resistance as compared to the same construction of textile layers without the particles. The key mechanism of improved spike penetration resistance of the treated fabric is believed to be inter-layer interactions.

The spike resistant textile layers 210 can have any suitable construction. The spike resistant textile layers 210 can comprise a plurality of yarns provided in a knit or woven construction. The construction of the textile layers 210 resists slippage of the fibers or yarns past one another. Alternatively, the spike resistant textile layers 210 can comprise a plurality of fibers provided in a suitable nonwoven construction (e.g., a needle-punched nonwoven, etc.).

For the embodiment where the spike resistant textile layers are in a woven construction, the woven layer preferably includes a multiplicity of warp and weft elements interwoven together such that a given weft element extends in a predefined crossing pattern above and below the warp element. One preferred weave is the plain weave where each weft element passes over a warp element and thereafter passes under the adjacent warp element in a repeating manner across the full width of the textile layer. Thus, the terms "woven" and "interwoven" are meant to include any construction incorporating interengaging formation fibers or yarns. In one embodiment, the spike resistant textile layers 210 comprise tightly woven aramid fabrics such as Dupont Kevlar Correctional™ fabric. In another embodiment, the spike resistant textile layers 210 comprise Teijin Twaron Microflex™ fabrics.

As will be understood by those of ordinary skill in the art, each textile layer within the grouping (or from one grouping to the next) can be independently provided in each of the aforementioned suitable constructions. For example, the first grouping 200 may have five (5) spike resistant textile layers 210 in a knit construction and five (5) spike resistant textile layers 210 in a woven construction. The different constructions may be grouped together, arranged in a repeating pattern or arranged randomly. In certain possibly preferred embodiments, the spike resistant textile layers 210 comprise a plurality of yarns 212 provided in a woven construction. In one embodiment, the textile layers 210 of the first group grouping 200 have a weave density of between about 20 and 45 warps and wefts per inch, more preferably between about 25 and 45 warps and wefts per inch.

In one embodiment, the spike resistance textile layers 210 have a tightness factor of greater than about 0.75 as defined in U.S. Pat. Nos. 6,133,169 (Chiou) and 6,103,646 (Chiou), which are incorporated herein by reference. "Fabric tightness factor" and "Cover factor" are names given to the density of the weave of a fabric. Cover factor is a calculated value relating to the geometry of the weave and indicating the percentage of the gross surface area of a fabric that is covered by yarns of the fabric. The equation used to calculate cover factor is as follows (from Weaving: Conversion of Yarns to Fabric, Lord and Mohamed, published by Merrow (1982), pages 141-143):

$d_w$=width of warp yarn in the fabric
$d_f$=width of fill yarn in the fabric
$p_w$=pitch of warp yarns (ends per unit length)
$p_f$=pitch of fill yarns $$C_w = \frac{d_w}{p_w} C_f = \frac{d_f}{p_f}$$

$$\text{Fabric_Cover_Factor} = Cfab = \frac{\text{total_area_obsured}}{\text{area_enclosed}}$$

-continued $$C_{fab} = \frac{(p_w - d_w)d_f + d_w p_f}{p_w p_f}$$

$$C_{fab} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric_tighness_factor} = \frac{\text{actual_cover_factor}}{\text{maximum_cover_factor}}$$

For example, the maximum cover factor that is possible for a plain weave fabric is 0.75; and a plain weave fabric with an actual cover factor of 0.68 will, therefore, have a fabric tightness factor of 0.91. The preferred weave for practice of this invention is plain weave.

The yarns or fibers 212 of the spike resistant textile layers 210 can comprise any suitable fibers. Yarns or fibers 212 suitable for use in the spike resistant textile layer 210 generally include, but are not limited to, high tenacity and high modulus yarns or fibers, which refers to yarns that exhibit a relatively high ratio of stress to strain when placed under tension. In order to provide adequate protection against ballistic projectiles, the yarns or fibers of the spike resistant textile layers 210 typically have a tenacity of about 8 or more grams per denier. In certain possibly preferred embodiments, the yarns or fibers of the spike resistant textile layers 210 can have a tenacity of about 10 or more grams per denier, more preferably 15 or more grams per denier.

Figure 2:
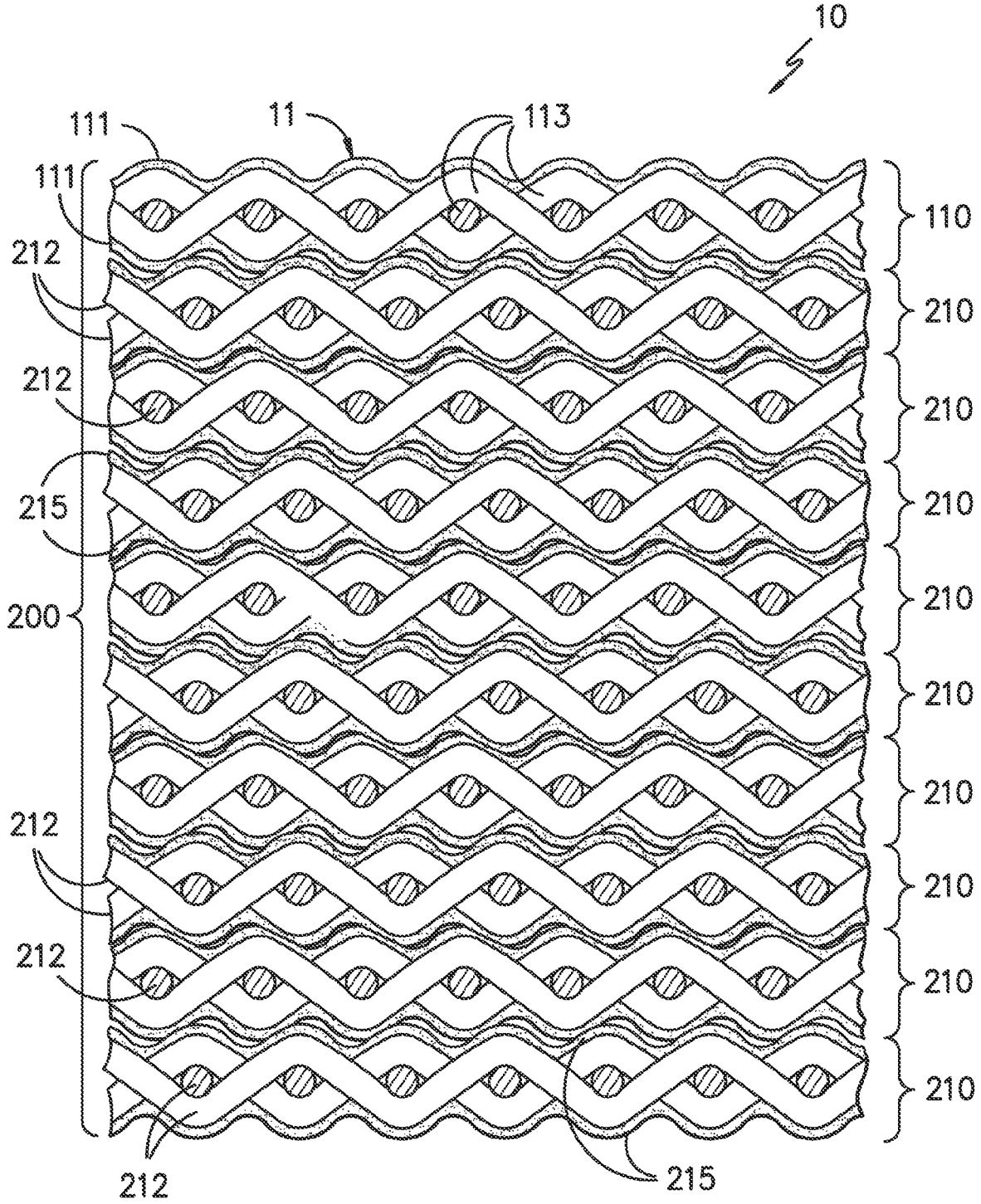
FIG. 2 is a cross-sectional view of one embodiment of the first grouping of spike resistant textile layers.

Referring to FIG. 2, which is an enlarged view of the first grouping, it can be seen that the spike resistant textile layers 210 comprises an optional coating 215 on at least a surface thereof in a weight of about 10 wt. % or less, based on the total weight of the textile layer, of a coating comprising a plurality of particles having a diameter of about 20 μm or less. In certain possibly preferred embodiments, the coating can penetrate into the interior portion of the textile layer 210 to at least partially coat the yarns or fibers 212 of the spike resistant textile layer 210.

The coating 215 applied to the spike resistant textile layers 210 comprises particulate matter (e.g., a plurality of particles). The particles included in the coating 215 can be any suitable particles, but preferably are particles having a diameter of about 20 μm or less, or about 10 μm or less, or about 1 μm or less (e.g., about 500 nm or less or about 300 nm or less). Particles suitable for use in the coating include, but are not limited to, silica particles, (e.g., fumed silica particles, precipitated silica particles, alumina-modified colloidal silica particles, etc.), alumina particles (e.g. fumed alumina particles), and combinations thereof. In certain possibly preferred embodiments, the particles are comprised of at least one material selected from the group consisting of fumed silica, precipitated silica, fumed alumina, alumina modified silica, zirconia, titania, silicon carbide, titanium carbide, tungsten carbide, titanium nitride, silicon nitride, and the like, and combinations thereof. Such particles can also be surface modified, for instance by grafting, to change surface properties such as charge and hydrophobicity. Suitable commercially available particles include, but are not limited to, the following: CAB-O-SPERSE®PG003 fumed alumina, which is a 40% by weight solids aqueous dispersion of fumed alumina available commercially from Cabot Corporation of Boyertown, Pa. (the dispersion has a pH of 4.2 and a median average aggregate particle size of about 150 nm); SPECTRAL™ 51 fumed alumina, which is a fumed alumina powder available commercially from Cabot Corporation of Boyertown, Pa. (the powder has a BET surface area of 55 m2/g and a median average aggregate particle size of about 150 nm); CAB—O-SPERSE® PG008 fumed alumina, which is a 40% by weight solids aqueous dispersion of fumed alumina available commercially from Cabot Corporation of Boyertown, Pa. (the dispersion has a pH of 4.2 and a median average aggregate particle size of about 130 nm); SPECTRAL™ 81 fumed alumina, which is a fumed alumina powder available commercially from Cabot Corporation of Boyertown, Pa. (the powder has a BET surface area of 80 $m^2$/g and a median average aggregate particle size of about 130 nm); AEROXIDE ALU C fumed alumina, which is a fumed alumina powder available commercially from Degussa, Germany (the powder has a BET surface area of 100 $m^2$/g and a median average primary particle size of about 13 nm); LUDOX® CL-P colloidal alumina coated silica, which is a 40% by weight solids aqueous sol available from Grace Davison (the sol has a pH of 4 and an average particle size of 22 nm in diameter); NALCO® 1056 aluminized silica, which is a 30% by weight solids aqueous colloidal suspension of aluminized silica particles (26% silica and 4% alumina) available commercially from Nalco; LUDOX® TMA colloidal silica, which is a 34% by weight solids aqueous colloidal silica sol available from Grace Davison. (the sol has a pH of 4.7 and an average particle size of 22 nm in diameter); NALCO® 88SN-126 colloidal titanium dioxide, which is a 10% by weight solids aqueous dispersion of titanium dioxide available commercially from Nalco; CAB-O-SPERSER S3295 fumed silica, which is a 15% by weight solids aqueous dispersion of fumed silica available commercially from Cabot Corporation of Boyertown, Pa. (the dispersion has a pH of 9.5 and an average agglomerated primary particle size of about 100 nm in diameter); CAB-O-SPERSE® 2012A fumed silica, which is a 12% by weight solids aqueous dispersion of fumed silica available commercially from Cabot Corporation of Boyertown, Pa. (the dispersion has a pH of 5); CAB-O-SPERSE® PG001 fumed silica, which is a 30% by weight solids aqueous dispersion of fumed silica available commercially from Cabot Corporation of Boyertown, Pa. (the dispersion has a pH of 10.2 and a median aggregate particle size of about 180 nm in diameter); CAB-O-SPERSE® PG002 fumed silica, which is a 20% by weight solids aqueous dispersion of fumed silica available commercially from Cabot Corporation of Boyertown, Pa. (the dispersion has a pH of 9.2 and a median aggregate particle size of about 150 nm in diameter); CAB-O-SPERSE® PG022 fumed silica, which is a 20% by weight solids aqueous dispersion of fumed silica available commercially from Cabot Corporation of Boyertown, Pa. (the dispersion has a pH of 3.8 and a median aggregate particle size of about 150 nm in diameter); SIPERNAT® 22LS precipitated silica, which is a precipitated silica powder available from Degussa of Germany (the powder has a BET surface area of 175 $m^2$/g and a median average primary particle size of about 3 μm); SIPERNAT® 500LS precipitated silica, which is a precipitated silica powder available from Degussa of Germany (the powder has a BET surface area of 450 $m^2$/g and a median average primary particle size of about 4.5 μm); and VP Zirconium Oxide fumed zirconia, which is a fumed zirconia powder available from Degussa of Germany (the powder has a BET surface area of 60 $m^2/g$).

In certain possibly preferred embodiments, the particles can have a positive surface charge when suspended in an aqueous medium, such as an aqueous medium having a pH of about 4 to 8. Particles suitable for use in this embodiment include, but are not limited to, alumina-modified colloidal silica particles, alumina particles (e.g. fumed alumina particles), and combinations thereof. In certain possibly preferred embodiments, the particles can have a Mohs' hardness of about 5 or more, or about 6 or more, or about 7 or more. Particles suitable for use in this embodiment include, but are not limited to, fumed alumina particles. In certain possibly preferred embodiments, the particles can have a three-dimensional branched or chain-like structure comprising or consisting of aggregates of primary particles. Particles suitable for use in this embodiment include, but are not limited to, fumed alumina particles, fumed silica particles, and combinations thereof.

The particles included in the coating can be modified to impart or increase the hydrophobicity of the particles. For example, in those embodiments comprising fumed silica particles, the fumed silica particles can be treated, for example, with an organosilane in order to render the fumed silica particles hydrophobic. Suitable commercially-available hydrophobic particles include, but are not limited to, the R-series of AEROSIL® fumed silicas available from Degussa, such as AEROSIL® R812, AEROSIL® R816, AEROSIL® R972, and AEROSIL® R7200. While not wishing to be bound to any particular theory, it is believed that using hydrophobic particles in the coating will minimize the amount of water that the layers and panel will absorb when exposed to a wet environment. When hydrophobic particles are utilized in the coating on the textile layers 210, the hydrophobic particles can be applied using a solvent-containing coating composition in order to assist their application. Such particles and coatings are believed to be more fully described in U.S. Patent Publication No. 2007/0105471 (Wang et al.), incorporated herein by reference.

The spike resistant textile layers 210 can comprise any suitable amount of the coating 215. As will be understood by those of ordinary skill in the art, the amount of coating applied to the spike resistant textile layers 210 generally should not be so high that the weight of the flexible panel 10 is dramatically increased, which could potentially impair certain end uses for the panel 10. Typically, the amount of coating 215 applied to the spike resistant textile layers 210 will comprise about 10 wt. % or less of the total weight of the textile layer 210. In certain possibly preferred embodiments, the amount of coating applied to the spike resistant textile layers 210 will comprise about 5 wt. % or less or about 3 wt. % or less (e.g., about 2 wt. % or less) of the total weight of the textile layer 210. Typically, the amount of coating applied to the spike resistant textile layers 210 will comprise about 0.1 wt. % or more (e.g., about 0.5 wt. % or more) of the total weight of the textile layer 210. In certain possibly preferred embodiments, the coating comprises about 2 to about 4 wt. % of the total weight of the textile layer 210.

In certain possibly preferred embodiments of the spike resistant package 10, the coating 215 applied to the spike resistant textile layers 210 can further comprise a binder. The binder included in the coating 215 can be any suitable binder. Suitable binders include, but are not limited to, isocyanate binders (e.g., blocked isocyanate binders), acrylic binders (e.g, nonionic acrylic binders), polyurethane binders (e.g., aliphatic polyurethane binders and polyether based polyurethane binders), epoxy binders, melamine-formaldehyde binders and combinations thereof. In certain possibly preferred embodiments, the binder is a cross-linking binder, such as a blocked isocyanate binder.

When present, the binder can comprise any suitable amount of the coating applied to the spike resistant textile layers 210. The ratio of the amount (e.g., weight) of particles present in the coating to the amount (e.g., weight) of binder solids present in the coating 215 typically is greater than about 1:1 (weight particles: weight binder solids). In certain possibly preferred embodiments, the ratio of the amount (e.g., weight) of particles present in the coating 215 to the amount (e.g., weight) of binder solids present in the coating typically is greater than about 2:1, or greater than about 3:1, or greater than about 4:1, or greater than about 5:1 (e.g., greater than about 6:1, greater than about 7:1, or greater than about 8:1). It is noted that when the coating 215 is applied to the spike resistant layer, the spike layer can have a much lower fabric tightness fabric to achieve the same level of spike resistance.

In certain possibly preferred embodiments, the coating 215 applied to the spike resistant textile layers 210 can comprise a water-repellant in order to impart greater water repellency to the flexible panel 10. The water-repellant included in the coating can be any suitable water-repellant including, but not limited to, fluorochemicals or fluoropolymers.

In one embodiment, the package 10 contains a second grouping of spike resistant fibers. The first and second groupings may have the same or different yarns/fibers, construction, weave density, particle coating. In one embodiment, the second grouping is on the first side **200*a* of the first grouping 200 and contains woven spike resistant layer having a tighter weave than the textile layers 210 of the first grouping 200. In one embodiment, the second grouping has a weave density of between about 30 and 80 warp yarns per inch and between about 30 and 80 weft yarns per inch. In another embodiment, the second grouping is on the first side 200*a* of the first grouping 200 and contains woven spike resistant layer having a looser weave than the textile layers 210 of the first grouping 200. In one embodiment, the second grouping has a weave density of between about 15 and 35 warp yarns per inch and between about 15 and 35 weft yarns per inch. The second grouping may have less, the same, or more textile layers than the first grouping 200**. In one embodiment, only one grouping contains the particle coatings (and the other groupings would not contain particle coatings).

Referring back to FIG. 1, there is shown a slip layer 300 in the package 10 within the pouch 100. The slip layer is a woven or knit textile and is placed on the second side **200*b* of the grouping of spike resistant layers 200 (an additional slip layer may be used on the first side 200*a* of the grouping of spike resistant layers or may be one slip layer that surrounds most or all of the grouping of spike resistant layers). When the package 10 is placed into an article, preferably the package 10 is oriented such that the slip layer 300 is between the grouping 200 and the pouch 100. In other embodiments, the slip layer is preferably further away from wearer of the article than the grouping 200 (so that it interacts with the spike before the spike resistant layers). The slip layer 300 may be loose within the pouch or may be adhered or otherwise attached to the inner surface 100*a* of the pouch 100 or the grouping 200. Preferably, this attachment is a loose or discontinuous attachment (such as a line of stitching or adhesive or grommets to allow for localized movement of the slip layer relative to the spike layers. The slip layer 300 is preferably in intimate contact with the inner surface 100***a* of the pouch 100, meaning that the slip layer 300 is in direct contact with the inner surface 100*a* with essentially nothing between them. The slip layer (or an additional slip layer) may also be positioned between layers of the grouping 200.

The slip layer is a woven or knit fabric having a first and second side and containing a main portion having an upper and lower side and a first pile portion on the upper surface of the main portion. The slip layer may also contain a second pile portion on the lower surface of the main portion. In some embodiments, a one-sided pile fabric may be preferred due to its lower weight and thickness. In certain situations, two-sided pile fabric may be preferred. When one-sided pile fabric is used, the pile side should preferably face toward the adjacent inner surface of the pouch.

Preferably, the slip layer has an average thickness of between about 0.5 and 5.0 mm measured following ASTM D1777. In one embodiment, the pile portion of the slip layer has an average thickness of between about 0.2 and 4.0 mm. If the pile portion is substantially thicker than the preferred range then there may be unneeded bulk (so this may add additional weight to the package without any additional benefit. If the slip layer is too thin then it may be less efficient in providing the needed slip for the package.

The slip layer contains a plurality of yarns knitted or woven together and a plurality of holes between the yarns. Preferably, the holes have an average max hole size of less than about 2 mm, more preferably less than about 1.5 mm, more preferably less than about 1 mm. Small holes help the slip layer to engage the spike as it penetrates the package. A smaller hole can more readily engage the spike. Larger holes are less able to engage the spike to help prevent penetration. Hole size is measured by optical microscope with backlighting. Each hole had two perpendicular measures taken with one measure being the longest opening length and the second being the measure taken at 90 degrees to the long measure. The hole size was taken as the average of the two measures. Any pile obstructing the view of the holes must be moved to allow proper measurement. All woven and knit fabrics should have holes that can be measured with sufficient backlighting and magnification, but some may be very small if the fabric is tightly woven or knitted. For fabrics with a variety of hole sizes, the largest regular holes in the fabric were measured for the average max hole size to avoid skewing the result by the inclusion of inconsequential small holes which might be present. Preferably, the slip layer contains between about 10 and 500 holes per $cm^2$. The slip layer preferably contains between about 15 and 300 holes per $cm^2$. Preferably, between about 1 and 60 percentage of the surface area of the slip layer formed by the holes. Woven or knit slip layers provide convenient ways to create an attached pile structure to the base(main) material. The pile creates most of the slip characteristics while the base provides the stability and engagement mechanism. Preferably, the connection between the pile and the base is continuously formed through a yarn or fiber structure which allows flexibility. The slip layer must have holes and preferably the holes have an average max hole size at greater than about 0.01 mm.

The plurality of yarns comprises a plurality of fibers and these yarns and fibers of the slip layer may be any suitable material. The fibers used in the slip layer may be natural fibers, synthetic fibers or inorganic fibers. The natural fibers may be cellulose derivatives such as cellulose fibers produced by plants, sea squirt or bacteria, or acetic acid cellulose, chitin derivatives such as chitin or chitosan contained in Crustacea such as shrimps or crabs, protein fibers such as hair, wool, silk or spider silk, nucleic acids such as DNA, or natural rubber fibers such as polyisoprene. The synthetic fibers may be various polymer fibers including polystyrene, polyacrylonitrile or polymethyl methacrylate, polyamide fibers such as nylon, polyester fibers such as polyethylene terephthalate or polyethylene naphthalate, polyolefin fibers such as polyethylene and polypropylene, polyurethane fibers, phenol resin fibers, melamine resin fibers, polyimide fibers or aramid fibers. The inorganic fibers may be glass fibers, metal oxides of, for example, aluminum, magnesium, calcium or titanium, pure metals or alloys, needle crystals of a compound containing a metal, carbon nanotubes or carbon fibers.

A portion of the yarns and fibers of the slip layer 300 reside in the main portion of the slip layer and a portion of the yarns and fibers of the slip layer 300 are in the pile portion of the slip layer. This main portion of the slip layer is the woven or knit structure of the texture where the yarns/fibers are knit or interwoven together. The pile portion of the slip layer are where the yarns and fibers are in loops or strands extending outward from the main portion of the slip layer. Generally, filament fibers are preferred in the pile portion of the slip layer. This would be, for example, similar to the pile of a velvet fabric, the fleece portion of a fleeced textile, or the loops on a terry cloth towel. The pile serves to decrease the shear resistance in the pack enhancing the ability for the layers separated by the slip layer to move relative to one another. The pile portion of the fibers and yarns is preferably oriented more or less perpendicularly to the main plane. Cut pile fibers and yarns may be preferred to loop pile fibers and yarns. The individual fibers or yarns are preferably stiff enough to be able to orient away from the main portion of the slip layer. Generally, polyester, nylon, rayon, or polyolefin are preferred fiber or yarn materials. In one embodiment, a spacer fabric may be used which is the un-slit form of a velvet or other cut pile construction which has one pile portion with two main portion structures. Soft or fine fibers which readily lay flat may be less preferred for some embodiments. In one preferred embodiment, the fabric is a woven velvet with 20-80 denier pile yarns. In another embodiment, the pile or loop yarns are 40-250 denier. The pile portion of the fabric are preferably at least 10% of the total weight of the slip layer in some embodiments.

While not wishing to be bound to any particular theory, it is believed that the pile on the slip layer plays a key role in breaking the interaction between the spike resistant layers and the inner surface of the pouch. Upon spike strike, a large normal force is applied to the vicinity of the impact point. This in turn creates a large friction force between the spike resistant layers and the inner surface of the pouch without the presence of the slip layer. As a result, the movement of the spike resistant layers is restricted. When a pile fabric as a slip layer is inserted, the movement of the spike resistant layers cannot be effectively restricted because the fibers in the pile portion of the slip layer are not restricted and are not oriented in the main plane of the fabric. In contrast, when a typical woven or knit fabric (without the pile portion) is used as a slip layer, the fibers in the fabric are substantially restricted in the main plane of the fabric. As a result, the frictional load can be effectively transferred from inner surface of the pouch to the spike resistant layers and the movement of the spike resistant layers is restricted.

As discussed above, an additional benefit of the slip layer is believed to be that it allows the spike resistant textile layers to move readily relative to the pouch inner surface allowing the spike to be more effectively stopped from penetrating the pack. When the layers are rigidly held by high resistance to slipping, they are less able to absorb the energy of the spike threat. Slippage between the body side layers and the inner pouch appears to be the most helpful in resisting penetration but one could envision that slippage between other layers in the pack could prove beneficial, too.

In one embodiment, the package 10 contains additional slip layers. These additional slip layers can be of the same materials and properties as the first slip layer 300 or may use different materials and have different properties. The additional slip layers may be in any suitable location within the pouch 100, for example, an additional slip layer on the inner surface of the pouch 100 on the second side 200*b* of the grouping 200, on the inner surface of the pouch 100 on the first side 200*a* of the grouping 200, within the grouping 200 between the spike resistant textile layers 210, and between the first grouping and second grouping of spike resistant textile layers.

In one embodiment, the slip layer has a compressibility of between about 10 and 80%, and in an additional embodiment, preferably between about 15 and 75%, as measured by the following equation:

$$\text{Compressibility } (\%) = (D_{low} - D_{high})/D_{low} * 100$$

Where $D_{low}$ is the thickness of the slip layer measured when applying a load of 1.7 kPa to the slip layer and $D_{high}$ is the thickness of the slip layer measured when applying a load of 34.5 kPa to the slip layer. This compression test is referred to as "Low Compressibility" in the testing.

In another embodiment, the slip layer has a compressibility of between about 65 and 90% as measured by the same equation where $D_{low}$ is the thickness measured when applying a low load of 1.7 kPa to the thickness measurement and $D_{high}$ is the thickness measured when applying a high load of 172 kPa to the thickness measurement. This compression test is referred to as "High Compressibility" in the testing.

Figure 3:
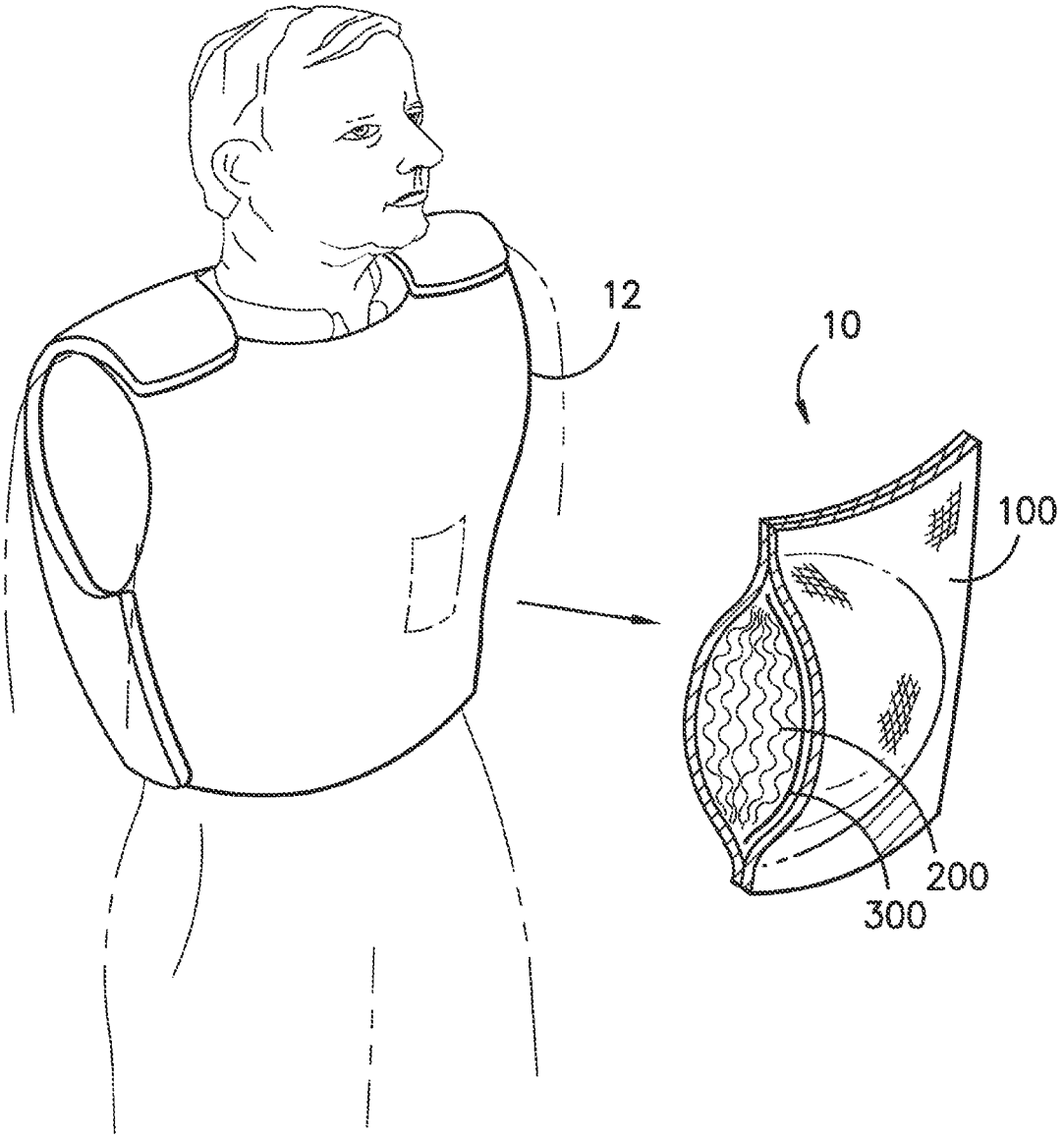
FIG. 3 is an illustration of one embodiment of an article containing a spike resistant package.

In one embodiment, the spike resistant package 10 is flexible, where flexible is defined to be able to be bent to a radius of one foot or less without effecting performance The slip layer is preferably bends easily in half by hand using little force. The spike resistant package 10 of the invention is particularly well suited for use in personal protection devices, such as personal body armor. For example, as depicted in FIG. 3, the spike resistant package 10 can be incorporated into an article 12 (in this figure a vest) in order to provide the wearer protection against spike threats.

In one embodiment, the package 10 is incorporated into an article to protect the user from spike threats. Some articles include shirts, jackets, pants, vests, shoes, helmets, and hats. In one embodiment, the article contains a slot or pocket that the package 10 can be placed in and out of. Preferably, the package 10 is easily removable from the article for laundering.

In another embodiment, the package 10 may also contain layers directed towards knife and/or ballistics resistance. The makeup of these additional layers would be chosen by the desired package properties as well as the location of these layers within the package 10. The additional layers may add additional spike, knife, and/or ballistic resistance or other desired properties. Examples of suitable known puncture resistant materials or components include, but are not limited to, mail (e.g., chain mail), metal plating, ceramic plating, layers of textile materials made from high tenacity yarns which layers have been impregnated or laminated with an adhesive or resin, or textile materials made from low denier high tenacity yarns in a tight woven form such as DuPont KEVLAR CORRECTIONAL® available from DuPont.

Commercially-available, flexible ballistic resistant panels such as those described above include, but are not limited to, the SPECTRA SHIELD® high-performance ballistic materials sold by Honeywell International Inc. Such ballistic resistant laminates are believed to be more fully described in U.S. Pat. Nos. 4,916,000 (Li et al.); 5,437,905 (Park); 5,443,882 (Park); 5,443,883 (Park); and 5,547,536 (Park), each of which is herein incorporated by reference. Other commercially available high performance flexible ballistic resistant materials include DYNEEMA UD® available from DSM Dymeema, and GOLDFLEX® available from Honeywell International Inc. These high performance flexible ballistic materials may be used together with the spike resistant package 10 to enhance overall ballistic performance.

The process to form spike resistant textile layers 210 where the spike resistant textile layers 210 comprising a plurality of interwoven yarns or fibers having a tenacity of about 5 or more grams per denier, wherein at least one of the surfaces of the spike resistant textile layer comprises about 10 wt. % or less, based on the total weight of the textile layer, of a coating comprising a plurality of particles having a diameter of about 20 μm or less comprises the steps of (a) providing a first textile layer, (b) contacting at least one of the lower surface of the first textile layer with a coating composition comprising a plurality of particles having a diameter of about 20 μm or less, and (c) drying the textile layer treated in step (b) to produce a coating on the lower surface of the first textile layer or the upper surface of the second textile layer.

The surface(s) of the textile layers can be contacted with the coating composition in any suitable manner. The textile layers can be contacted with the coating composition using conventional padding, spraying (wet or dry), foaming, printing, coating, and exhaustion techniques. For example, the textile layers can be contacted with the coating composition using a padding technique in which the textile layer is immersed in the coating composition and then passed through a pair of nip rollers to remove any excess liquid. In such an embodiment, the nip rollers can be set at any suitable pressure, for example, at a pressure of about 280 kPa (40 psi). Alternatively, the surface of the textile layer to be coated can be first coated with a suitable adhesive, and then the particles can be applied to the adhesive.

The coated textile layers can be dried using any suitable technique at any suitable temperature. For example, the textile layers can be dried on a conventional tenter frame or range at a temperature of about 160° C.(320° F.) for approximately five minutes. The formed spike resistant textile layer comprises about 10 wt. % or less, based on the total weight of the textile layer, of a coating comprising a plurality of particles having a diameter of about 20 μm or less may be found in US Patent Publication 2007/0105471 (Wang et al.), incorporated herein by reference.

The layers 210 can be disposed adjacent to each other and held in place relative to each other by a suitable enclosure, such as a pocket or can be attached to each other by any known fastening means. In certain possibly preferred embodiments the layers 110 and 210 can also be sewn together in a desired pattern, for example, around the corners or along the perimeter of the stacked textile layers in order to secure the layers in the proper or desired arrangement.

Additionally, the layers 210 and 110 may be adhered together using a patterned adhesive or other fastening means such as rivets, bolts, wires, tape, or clamps. In one embodiment, the layers are loose (not attached to each other using any adhesive or mechanical means are placed together within the pouch.

EXAMPLES

Various embodiments of the invention are shown by way of the Examples below, but the scope of the invention is not limited by the specific Examples provided herein.

Test Methods

Spike Resistance Test Method

Spike stab resistance was tested according to NIJ Standard 0115.00 (2000), entitled "Stab Resistance of Personal Body Armor". The stab energy of the drop mass was set at 50 J (Protection Level 2 at "E2" strike energy). "Passing" is defined to be a penetration of less than 20 mm. The NIJ engineered spikes were used as the threat weapon purchased from Contra Threat Sciences, LLP.

Lab Scale Screening Stab Test

A lab scale screening stab test was used to evaluate the performance of the candidate slip layers. The standard composite backing material as specified in NIJ Standard 0115.00 (2000) was used as the backing material. A 1.5 mm thick silicone sheet was used to mimic the coated pouch. The test materials were stacked in the following configuration (Backing material on bottom): Backing material/4 spike resistant textile layers/1 slip layer/silicone sheet The size of the spike resistant layers and the slip layer were typically 20 cm×20 cm.

A standard engineered spike as specified in NIJ Standard-0115.00 was used as the stab weapon impacting the silicone sheet side of the stack. The material stack was stabbed vertically three to six times at a speed of 1 to 3 m/s and the performance was rated from 1 to 5, with 5 being most resistant to penetration. The performance rating as tested with the lab scale screening stab test correlated reasonably well with standard NIJ-0115.00 spike resistant test.

Thickness Measurement Test

A compression fixture with 57.4 mm diameter round plates was used to compress samples larger than those plates at 12.5 mm/min. Thickness was taken from the strain measurement at various load values. A standard thickness measure for textiles is taken at 4.1 kPa (0.6 psi) according to ASTM D1777, so where thickness is mentioned without load, this is the method to which we refer.

Materials

Pouch Material

The pouch of the package was a water-resistant bag sealed on three sides. Often an inner and outer pouch are used in testing to represent the inner pouch encasing the spike-resistant material and the outer carrier fabric making up the primary vest. The different fabric compositions, areal densities, thicknesses, and backing coating compositions are listed in Table 1. All of these pouch fabrics had a water repellent finish.

TABLE 1

Pouch compositions

| Pouch | Yarn Denier | Weave | Back Coating | Areal Density (g/m2) | Thickness (mm) |
|---|---|---|---|---|---|
| Nylon Pouch I | 70 d | ripstop | polyurethane | 130 | 0.15 |

TABLE 1-continued

Pouch compositions

| Pouch | Yarn Denier | Weave | Back Coating | Areal Density (g/m2) | Thickness (mm) |
|---|---|---|---|---|---|
| Nylon Pouch III | 70 d | ripstop | polyurethane | 75 | 0.11 |
| Nylon Pouch IV | 500 d | plain | acrylic | 241 | 0.37 |
| PET/Cotton Pouch II | | plain | none | 170 | |

Spike Resistant Textile Layers—Spike Material "A"

A KEVLAR® fabric JPS STYLE 767® available from JPS Composite Materials located in Anderson, South Carolina, was obtained. The Kevlar fabric was comprised of KEVLAR KM2+600 denier warp and fill yarns woven together in a plain weave construction with 28 ends/inch and 28 picks/inch. The fabric layer weighed 150 gsm after scouring to remove any yarn finishes present. A spike resistant layer was prepared by coating the KEVLAR® fabric in an aqueous bath comprising:

a) approximately 20% CAB—O-SPERSE PG003®, a fumed alumina dispersion (40% solids) with 150 nm particle size available from Cabot Corporation, and b) 2% MILLITEX RESIN MRX®, a blocked isocyanate based cross-linking agent (35-45% by wt. solids) available from Milliken Chemical.

The solution was applied using a padding process (dip and squeeze at a roll pressure of 40 psi). The fabric was then dried at 320° F. The dry weight add-on of the chemical on the fabric was approximately 2%. The coated fabric layer will be designated as material "A" in the following examples.

Spike Resistant Textile Layers—Spike Material "B"

A KEVLAR® fabric Lincoln Fabric STYLE 30041.0635.3511 was obtained. It was comprised of KEVLAR 159, 200 denier warp and fill yarns in a 70×70 construction, scoured. This material will be designated as material "B" in the following examples.

Slip Layer

The following compositions shown in Tables 2A and 2B were used as slip layers in the examples.

TABLE 2A

Slip layer composition and properties

| Slip Layer | | Fabric Type | Weight (gsm) | Hole Size (mm) Avg |
|---|---|---|---|---|
| 1 | PET fleece | Knit | 214 | 0.30 |
| 2 | PET Spacer fabric | Knit | 241 | 0.50 |
| 3 | One-Sided PET fleece | Knit | 245 | 0.17 |
| 4 | PET jersey knit | Knit | 125 | 0.25 |
| 5 | Cotton terry cloth towel | Knit | 360 | 0.15 |
| 6 | PET microdenier terry cloth towel | Knit | 606 | 0.75 |
| 7 | PET one-sided loop knit terry | Knit | 259 | 0.20 |
| 8 | PET Velvet | Woven | 177 | 0.10 |
| 9 | Rayon Velvet | Woven | 211 | 0.06 |
| 10 | 5 mm foam | N/A | 172 | 0.00 |
| 11 | Woven nylon | Woven | 224 | 0.03 |
| 12 | Open Insulation knit | Knit | 136 | 1.6 |

TABLE 2B

| Slip layer properties and performance rating | | | | |
|---|---|---|---|---|
| | Thickness | Compressibility (%) | | Lab Scale Screening |
| | (mm) | Low | High | Stab Test |
| 1 | 2.03 | 68.2% | 82.6% | 5 |
| 2 | 2.04 | 16.2% | 75.0% | 4 |
| 3 | 1.42 | 54.3% | 78.0% | 4 |
| 4 | 0.33 | 32.6% | 76.7% | 1 |
| 5 | 2.82 | 34.8% | 55.6% | 3 |
| 6 | 2.21 | 46.9% | 69.3% | 3 |
| 7 | 0.74 | 34.5% | 65.9% | 5 |
| 8 | 1.38 | 72.0% | 88.5% | 5 |
| 9 | 1.41 | 15.0% | 84.1% | 4 |
| 10 | 4.97 | 12.6% | 62.1% | 1 |
| 11 | 0.25 | 21.8% | 63.2% | 1 |
| 12 | 1.2 | 66.9% | 81.0% | 2 |

Without wishing to be bound to any particular theory, the slip layer is best able to assist the spike resistant materials in stopping spike penetration when it can provide sufficient movement of the spike resistant materials in the pack. This movement is most easily achieved with a material which has sufficient thickness and compressibility to provide room in the pack for the spike material to buckle in response to the impact of the spike. A slip layer which is too readily compressed will not have sufficient thickness when sealed in the pack. A slip layer which is difficult to compress will restrict the movement of the spike resistant materials in the pack by not creating extra room for movement during impact. The small hole size assists the engagement of the spike to enhance the response of both the slip layer and the spike resistant materials during the impact.

The slip materials characterized in Tables 2A and 2B include 3 examples which do not meet the definition of a good slip layer material. Materials 4, 10, and 11 in the table do not have sufficient thickness, compressibility, and/or structure to be helpful as slip materials in the invention as defined here. Materials 1 and 8 rated best in the screening stab test and have good values for thickness, compressibility, and hole size according to the preferred values. Material 7 was on the lower end of thickness requirement but still performed very well in the screening test. It can be further characterized by having loops extending over 1.25 mm from the base which further aided in the performance. Materials 2, 3, and 9 were rated a "4" in the screening stab test performing nearly as well. Materials 5 and 6 were less desirable than the aforementioned due to the compressibility values. Material 12 had the largest average hole size of the materials tested and was less desirable due to that fact.

EXAMPLES

The inner pouch, slip layer, spike material/plies, and outer pouch materials and the results of the spike testing for each example are shown in Table 3. The assembly was tested for spike stab resistance according to NIJ 0115.00 level 2 E2.

The four most promising slip layers from the Lab Scale Screening Stab Test were used in more extensive testing according to NIJ 0115.00 level 2 E2.

Example 1

Example 1 was formed from encasing 14 layers (or plies) of spike resistant fabric A in the nylon pouch Ill which was then inserted into outer pouch IV to form the package. No slip layer was used in example 1.

Example 2

Example 2 was formed from encasing 14 layers (or plies) of spike resistant fabric A in the nylon pouch III. Slip resistant layer 1 was inserted on each side of the spike resistant layers separating the spike resistant material from the pouch. This layup was then inserted into outer pouch IV to form the package.

Example 3

Example 3 was formed from encasing 17 layers (or plies) of spike resistant fabric B in the nylon pouch I which was then inserted into outer pouch IV to form the package. No slip layer was used in example 1.

Example 4

Example 4 was formed from encasing 17 layers (or plies) of spike resistant fabric B in the nylon pouch I. Slip resistant layer 7 was inserted on each side of the spike resistant layers separating the spike resistant material from the pouch. The loop side of layer 7 faced the pouch wall. This layup was then inserted into outer pouch IV to form the package.

Example 5

Example 5 was formed from encasing 17 layers (or plies) of spike resistant fabric B in the nylon pouch I. Slip resistant layer 8 was inserted on each side of the spike resistant layers separating the spike resistant material from the pouch. The pile side of layer 8 faced the pouch wall. This layup was then inserted into outer pouch IV to form the package.

Example 6

Example 6 was formed from encasing 12 layers (or plies) of spike resistant fabric A in the nylon pouch I which was then inserted into outer pouch II to form the package. No slip layer was used in example 1.

Example 7

Example 7 was formed from encasing 12 layers (or plies) of spike resistant fabric A in the nylon pouch I. Slip resistant layer 7 was inserted on each side of the spike resistant layers separating the spike resistant material from the pouch. The loop side of layer 7 faced the pouch wall. This layup was then inserted into outer pouch II to form the package.

Example 8

Example 8 was formed from encasing 12 layers (or plies) of spike resistant fabric A in the nylon pouch I. Slip resistant layer 8 was inserted on each side of the spike resistant layers separating the spike resistant material from the pouch. The pile side of layer 8 faced the pouch wall. This layup was then inserted into outer pouch II to form the package.

Example 9

Example 9 was formed from encasing 13 layers (or plies) of spike resistant fabric A in the nylon pouch Ill which was then inserted into outer pouch II to form the package. No slip layer was used in example 1.

Example 10

Example 10 was formed from encasing 13 layers (or plies) of spike resistant fabric A in the nylon pouch III. Slip resistant layer 2 was inserted on each side of the spike resistant layers separating the spike resistant material from the pouch. This layup was then inserted into outer pouch II to form the package.

Example 11

Example 11 was formed from encasing 13 layers (or plies) of spike resistant fabric A in the nylon pouch III. Slip resistant layer 1 was inserted on the top/strike side of the spike resistant layers separating the spike resistant material from the pouch. This layup was then inserted into outer pouch II to form the package.

DISCUSSION OF RESULTS

Tables 2A and 2B show the properties of the various slip layers analyzed in the lab including the lab scale screening stab test. Table 3 shows the testing results of the examples.

TABLE 3

Results from NIJ 0115.00 Spike level 2, energy level 2 for Examples

| Example | Inner Pouch | Slip Layer | Spike material/ plies | Outer Pouch | Spike Penetration (mm) |
|---|---|---|---|---|---|
| 1 | III | None | A/14 | IV | 42 |
| 2 | III | 1 | A/14 | IV | 0 |
| 3 | I | None | B/17 | IV | 45 |
| 4 | I | 7 | B/17 | IV | 0 |
| 5 | I | 8 | B/17 | IV | 0 |
| 6 | I | None | A/12 | II | 44 |
| 7 | I | 7 | A/12 | II | 0 |
| 8 | I | 8 | A/12 | II | 0 |
| 9 | III | None | A/13 | II | 43 |
| 10 | III | 2 | A/13 | II | 0 |
| 11 | III | 1 (top only) | A/13 | | 0 |

For the testing according to NIJ 0115.00 Spike level 2, examples 1, 3, 6, and 9 in the table which had no slip layer all had failing results in the stab test. Upon insertion of the slip layer (slip layers 1, 2, 7, or 8) on one or both sides of the spike resistant layers, the samples all passed the stab test. This was true for various combinations of pouch materials.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A spike resistant package comprising:

a pouch, wherein the pouch having an inner surface, an outer surface, and an enclosed space;

a first grouping of spike resistant textile layers, wherein the grouping has a first side, a second side, and comprises plurality of spike resistant textile layers, wherein each spike resistant textile layer comprises a plurality of interwoven yarns or fibers having a tenacity of about 14 or more grams per denier, wherein the first grouping of spike resistant textile layers is located within the enclosed space of the pouch; and, a slip layer being a woven or knit fabric having a first and second side and comprising a main portion having an upper and lower side and a first pile portion on the upper surface of the main portion, wherein the slip layer comprises a plurality of yarns knitted or woven together and a plurality of holes between the yarns, wherein the plurality of yarns comprise a plurality of fibers, wherein the slip layer is located within the enclosed space of the pouch between the first grouping of spike resistant textiles layers and the inner surface of the pouch;

wherein the holes have an average max hole size of less than about 2 mm, wherein a portion of the yarns and fibers of the slip layer reside in the main portion of the slip layer and a portion of the yarns and fibers of the slip layer are in the pile portion of the slip layer, wherein the yarns and fibers in the pile portion are in loops or strands extending outward from the main portion of the slip layer, and wherein the slip layer has a thickness greater than about 0.5 mm.

2. The spike resistant package of claim 1, wherein the holes have an average max hole size at greater than about 0.01 mm.

3. The spike resistant package of claim 1, wherein the slip layer has a thickness of between about 0.5 mm and 5 mm.

4. The spike resistant package of claim 1, wherein the slip layer has a compressibility of between about 10 and 80% as measured by the following equation:

$$\text{Compressibility } (\%) = (D_{low} - D_{high})/D_{low} * 100$$

wherein $D_{low}$ is the thickness of the slip layer measured when applying a load of 1.7 kPa and $D_{high}$ is the thickness of the slip layer measured when applying a load of 34.5 kPa.

5. The spike resistant package of claim 1, wherein the slip layer has a compressibility of between about 15 and 75% as measured by the following equation:

$$\text{Compressibility } (\%) = (D_{low} - D_{high})/D_{low} * 100$$

wherein $D_{low}$ is the thickness of the slip layer measured when applying a load of 1.7 kPa and $D_{high}$ is the thickness of the slip layer measured when applying a load of 34.5 kPa.

6. The spike resistant package of claim 1, further comprising a second pile portion on the lower surface of the main portion of the slip layer.

7. The spike resistant package of claim 1, wherein the holes have an average max hole size of less than about 1 mm.

8. The spike resistant package of claim 1, wherein the pile portion of the slip layer has an average thickness of about 0.2 to 4.0 mm.

9. The spike resistant package of claim 1, wherein the slip layer contains between about 10 and 500 holes per $cm^2$.

10. The spike resistant package of claim 1, wherein between about 1 and 60 percentage of the surface area of the slip layer formed by the holes.

11. The spike resistant package of claim 1, wherein the yarns and fibers of the slip layer comprise a material selected from the group consisting of polyester, polyamide, polyolefin, rayon, and mixtures thereof.

12. The spike resistant package of claim 1, wherein the grouping of spike resistant textile layers comprises at least 4 spike resistant textile layers.

13. The spike resistant package of claim 1, wherein the spike resistant textile layers are woven textile layers comprising a plurality of warp yarns and weft yarns, wherein spike resistant textile layers of the first grouping having a weave density of between about 20 and 45 warp yarns per inch and between about 20 and 45 weft yarns per inch.

14. The spike resistant package of claim 1, further comprising additional slip layers.

15. An article of clothing for protection from spikes comprising an article of clothing and the package of claim 1.

16. The article of clothing of claim 13, wherein the package is oriented such that the second side of the first grouping of spike resistant textile layers faces the wearer of the article of clothing.

17. The article of clothing for of claim 13, wherein the article is selected form the group consisting of shirt, jacket, pants, vest, shoes, helmet, and hat.

18. The spike resistant package of claim 1, wherein at least a portion of the spike resistant woven textile layers comprise about 10 wt. % or less, based on the total weight of the spike resistant woven textile layer, of a coating comprising a plurality of particles having a diameter of about 20 μm or less on at least one of the surfaces of the spike resistant woven textile layer.

19. The spike resistant package of claim 16, wherein the particles are selected from the group consisting of silica, alumina, silicon carbide, titanium carbide, tungsten carbide, titanium nitride, silicon nitride, and combinations thereof.

20. The spike resistant package of claim 16, wherein the particles have a diameter of about 300 nm or less.

21. The spike resistant package of claim 1, wherein the yarns or fibers of the spike resistant woven textile layers comprise fibers selected from the group consisting of gel-spun ultrahigh molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof.

22. A spike resistant package of claim 1, further comprising:

a second grouping of spike resistant woven textile layers, wherein the grouping has a first side, a second side, and comprises at least 4 second spike resistant woven textile layers.

* * * * *